US008360020B2

(12) United States Patent
Auchter et al.

(10) Patent No.: US 8,360,020 B2
(45) Date of Patent: Jan. 29, 2013

(54) METHOD FOR DETERMINING A SCANNING RATIO FOR A VALVE FOR A CAMSHAFT ADJUSTER

(75) Inventors: Jochen Auchter, Gerhardshofen (DE); Marco Schmitt, Fulda (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 465 days.

(21) Appl. No.: 12/519,380

(22) PCT Filed: Nov. 24, 2007

(86) PCT No.: PCT/EP2007/061958

§ 371 (c)(1),
(2), (4) Date: Jun. 16, 2009

(87) PCT Pub. No.: WO2008/077674

PCT Pub. Date: Jul. 3, 2008

(65) Prior Publication Data

US 2010/0037843 A1 Feb. 18, 2010

(30) Foreign Application Priority Data

Dec. 22, 2006 (DE) ..... 10 2006 061 104

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS

| | | | | |
|---|---|---|---|---|
| 4,748,896 | A * | 6/1988 | Ott et al. | 91/448 |
| 5,333,577 | A | 8/1994 | Shinojima | |
| 6,513,473 | B2 * | 2/2003 | Daut | 123/90.17 |
| 6,622,675 | B1 | 9/2003 | Simpson | |
| 2002/0124821 | A1 | 9/2002 | Komazawa | |
| 2003/0010303 | A1 | 1/2003 | Kanada et al. | |
| 2003/0066501 | A1 * | 4/2003 | Park | 123/90.17 |
| 2003/0196618 | A1 | 10/2003 | Simpson | |

FOREIGN PATENT DOCUMENTS

| | | |
|---|---|---|
| DE | 19539734 | 5/1996 |
| DE | 10222680 | 5/2003 |
| DE | 10244541 | 4/2004 |
| DE | 102004016554 | 10/2005 |
| DE | 60300595 | 11/2005 |
| DE | 102004038252 | 12/2005 |
| DE | 102004048070 | 6/2006 |
| DE | 60302824 | 7/2006 |
| EP | 1357258 | 10/2003 |
| EP | 1375838 | 1/2004 |
| WO | 0127478 | 4/2001 |
| WO | 0179662 | 10/2001 |
| WO | 03074338 | 9/2003 |

* cited by examiner

*Primary Examiner* — Zelalem Eshete
(74) *Attorney, Agent, or Firm* — Volpe and Koenig, P.C.

(57) ABSTRACT

A method for determining a scanning ratio for a characteristic curve for the operation of an electromechanical valve for a camshaft adjuster in which an ambient temperature and a relative motion of a camshaft are determined at a reference point. In accordance with a specific ambient temperature and other operating conditions such as e.g., engine rpm, a holding scanning ratio is determined. Subsequently, at least one additional scanning ratio of an operating state is determined for a scanning ratio characteristic for the valve.

2 Claims, 4 Drawing Sheets

METHOD FOR DETERMINING A SCANNING RATIO FOR A VALVE FOR A CAMSHAFT ADJUSTER

BACKGROUND

The present invention relates to the field of camshaft adjusters. In particular, the present invention relates to a method for determining a scanning ratio for a characteristic curve for the operation of an electromechanical valve of a camshaft adjuster, to a computer program product for a motor controller, and to a data carrier with a corresponding computer program product.

For controlling a gas exchange, in a four-stroke combustion engine, a camshaft or control shaft is driven at half the engine speed of the crankshaft. Using its cams, the camshaft opens the gas-exchange valves constructed separately for pushing out the combusted gases and drawing in the fresh gases against the pressure in the cylinder and against the forces of the valve springs. The valves are activated in that the cams activate the valves mechanically. For this purpose, the camshaft is mounted in the combustion engine such that the cams mounted on the camshaft contact cam followers, for example, cup tappets, rocker arms, or finger levers that are in active connection, in turn, with the valves.

The coupling of a camshaft with the crankshaft is produced by a timing chain, a control belt, or a gear pair. Through this essentially rigid coupling, a fixed phase relationship is set between the rotation of the camshaft and the rotation of the crankshaft.

However, it has been shown that it can be advantageous for the operation of a combustion engine, in particular, with respect to fuel consumption and increase in power, to adjust this fixed phase relationship between the camshaft and the crankshaft during the operation of the motor. Through hydraulic or electric camshaft adjustment systems it is possible to adjust the phase relationship between the camshaft and the crankshaft when necessary. A hydraulic camshaft adjustment system has a camshaft adjuster and a valve. The camshaft adjuster operates according to the principle of vane cells and is placed between the control drive and the camshaft to be adjusted. For the case when there is no oil pressure in the combustion engine, e.g., when the motor is starting up, the camshaft adjuster still has mechanical locking. The locking position is located at an angular position within the adjustment region of the camshaft adjuster. The valve can be provided in the form of a central valve and controls the exchange of oil between the camshaft adjuster and the oil circuit of the motor. It is arranged in the center of the rotor. The arrangement of a valve in the motor, e.g., in the cylinder head, is also possible.

As soon as oil circulates around the central valve, the locking mechanism that connects a stator and a rotor of the camshaft adjustment system detaches in an undesired way, by which the rotor that is connected to the crankshaft can rotate relative to the stator that is connected to the crankshaft by the control drive.

A valve for a device for changing the control time of a combustion engine is known from the publication DE 10 2004 038 252 A1. Variable valve time behavior control devices are also known from the publications US 2002/0124821 A1 and US 2003/0010303 A1.

Known valves can produce incorrect adjustments during operation. The incorrect adjustment can lead to an uncontrolled opening of the locking, so-called middle locking, by which, for example, undesired noises could be generated in the camshaft adjustment system. These noises negatively influence the driving comfort of the vehicle.

SUMMARY

An objective of the present invention is to provide for efficient operation of the valve.

Accordingly, a method for determining a scanning ratio for a characteristic curve for operating an electromechanical valve of a camshaft adjuster, a computer program product for a motor controller, and a data carrier with a corresponding computer program product are provided.

According to an exemplary embodiment of the present invention, a method for determining a scanning ratio for a characteristic curve for operating an electromechanical or electromagnetic valve of a camshaft adjuster is specified, wherein an ambient temperature of the camshaft adjuster is initially determined by the method. In addition, a relative movement of a camshaft or a first shaft to a reference point is determined. A scanning ratio of the electromechanical valve is adjusted until the relative movement of the camshaft to the reference point is essentially stopped. This scanning ratio can also involve a scanning ratio range or a scanning ratio interval.

The scanning ratio can correspond to a first operating state in which a position of the camshaft adjuster is held constant. If a scanning ratio lies essentially in this interval, then the relative movement of the camshaft to the reference point is stopped to the greatest possible extent. The determined scanning ratio is stored as a hold scanning ratio at the determined ambient temperature. Starting from the hold scanning ratio, at least one other scanning ratio at the determined ambient temperature is determined. Here, the scanning ratio that is stored corresponds to an operating state of the valve.

The one or more other scanning ratios could be allocated to an operating state of the valve or a valve position. Thus, a characteristic curve could be determined that is valid for a valve at a determined ambient temperature. Through the use of this temperature-dependent characteristic curve, a valve could be controlled at a determined ambient temperature. Thus, operating states of the valve could be reliably started up or adjusted.

Determining the relative movement of the camshaft to the reference point could be realized, for example, in that the phase position of the camshaft is considered relative to a crankshaft. Because the camshaft could be coupled with the rotor of a camshaft adjuster and the crankshaft could be coupled with the stator of a camshaft adjuster, a relative relationship of the stator to the rotor could also be considered.

By considering the ambient temperature and, in particular, the ambient temperature of the camshaft adjuster, a better adjustment of a valve could be achieved. Consequently, an incorrect, i.e., too advanced or too retarded opening of locking of a camshaft adjuster could be prevented.

According to another exemplary embodiment of the present invention, a method for realizing a motor shutdown for stopping a motor with the help of an electromechanical valve of a camshaft adjuster is specified, wherein the method first determines an ambient temperature of the camshaft adjuster. In addition, a relative movement of a camshaft to a reference point is determined. A scanning ratio of the electromagnetic valve is adjusted until the relative movement of the camshaft to the reference point has essentially stopped. The determined scanning ratio is stored as a hold scanning ratio at the determined ambient temperature. Starting from the determined hold scanning ratio, at least one other scanning ratio is determined at the determined ambient temperature.

The method for realizing a motor shutdown further features the recognition of a stop condition. After the stop condition has been recognized, the rotational speed of a crankshaft or a second shaft is determined, wherein the rotational speed of the second shaft could be an engine speed and wherein the rotational speed of the crankshaft could be coupled with the rotational speed of the camshaft. Then the adjustment angle of the camshaft adjuster is set deviating from a locking angle. In particular, the adjustment angle of the camshaft adjuster could be set deviating from a locking angle, so that a phase deviation is produced that corresponds to an advanced phase angle relative to the reference phase angle.

For setting the adjustment angle, another determined or stored scanning ratio and the hold scanning ratio are referenced. The adjustment angle deviating from the locking angle is held until the rotational speed of the crankshaft has reached the value zero.

The recognition of a stop condition could be, for example, the shutdown of a motor, in particular, a combustion engine. Due to drag moments when a motor is started following the shutdown of a motor, it can be desired for the camshaft adjuster to be located in a position corresponding to an advanced phase angle for the shutdown. For the next motor start phase, the camshaft adjuster could be brought automatically into a mechanical locking position due to the drag moments. Thus it can be desired to keep the camshaft adjuster in an advanced phase position as long as the rotational speed of a motor during the shutdown phase deviates from zero, i.e., as long as the motor is still running. The size of the phase difference can be set arbitrarily as long as the deviation lies above the middle locking position.

According to another exemplary embodiment of the present invention, a method for realizing a motor start with the help of an electromechanical valve of a camshaft adjuster is specified, wherein first an ambient temperature of the camshaft adjuster is determined by the method. In addition, a relative movement of a camshaft to a reference point is determined. A scanning ratio of the electromagnetic valve is set until the relative movement of the camshaft to the reference point has essentially stopped. The determined scanning ratio is stored as a hold scanning ratio at the determined ambient temperature. Starting from the determined hold scanning ratio, at least one other scanning ratio is determined at the determined ambient temperature.

The method for starting the motor also has the recognition of a start condition. If the start condition is recognized, such as, for example, the activation of the ignition, the camshaft adjuster is held by a mechanism, for example, by a locking bolt, while the rotational speed of a crankshaft is equal to zero. Here, the rotational speed of the crankshaft is coupled with the rotational speed of the camshaft. In the motor start phase, the rotational speed of the crankshaft is increased and as soon as the rotational speed deviates from zero and a system pressure is reached, the mechanical locking is detached and the camshaft adjuster is held by a hydraulic system. For this purpose, the camshaft adjuster is regulated by adjusting of another scanning ratio and/or by adjusting the hold scanning ratio.

Here, the start condition could be the startup of a motor, in particular, a combustion engine, using an ignition key. To prevent noises of the camshaft adjuster, it can be desired to keep the camshaft adjuster and, in particular, the rotor and the stator of the camshaft adjuster in a fixed phase position relative to each other as long as a system pressure has not yet been reached. Here, a system pressure could be a minimum system pressure that is needed at least for the operation of a motor and, in particular, for the holding and regulating of a phase difference between the rotor and stator. A minimum necessary system pressure could lie, for example, in a range from 0.2 bar to 0.5 bar.

As long as the system pressure has not yet been reached, the rotor could be held mechanically and as soon as a sufficient system pressure is present, the rotor could be held and regulated hydraulically.

Because the camshaft and the crankshaft can be coupled, a dependency between a rotation of the camshaft and a rotation of the crankshaft can be given. Therefore, the recognition of the rotation of the camshaft can take place in the same way via the rotation of the crankshaft as the determination of the rotation of the crankshaft by a rotation of the camshaft. In this way, sensors that are used for determining the rotation of the corresponding shaft could be installed at a position that is favorable for assembly. Thus, existing sensors could be used for determining the rotation of the camshaft or the crankshaft. A crankshaft could have, for example, corresponding sensors for determining an engine speed.

According to another exemplary embodiment of the present invention, a computer program product for a motor control device is created that can be operated according to one of the methods listed above, wherein the routine for determining a scanning ratio is converted by corresponding control commands stored in software.

According to yet another exemplary embodiment of the present invention, a data carrier with a corresponding computer program product is created.

The position of an electromechanical valve or an electromagnetic valve can be adjusted by a current intensity that is fed to an electromechanical converter. In automotive engineering, because there might not be any ability for controlling a current, a current feed to an electromechanical converter at a constant supply voltage could be set using a scanning ratio. A scanning ratio here means that the electromechanical converter is supplied with a voltage during one part of a periodic time interval and the voltage is turned off during the other part of the periodic time interval.

During the time in which the voltage is turned on, a current that can be set based on the electrical resistance of the electromechanical converter can flow through the electromechanical converter. Here, an average value of the current can be produced with which an effective current intensity is adjustable by the electromechanical converter. A scanning ratio of 0% can here mean that, during the time interval, no voltage is turned on. In contrast, a scanning ratio of 100% can mean that, during the entire time period of the time interval, a voltage is supplied to the electromechanical converter.

The scanning ratio of 0% can here correspond to an idle state, an emergency running state, or a powerless state. During a powerless state, the electromechanical converter could have the lowest excitation. Through a scanning ratio of 0%, the electromechanical converter could have, for example, the smallest deflection. In contrast, during a scanning ratio of 100%, a maximum deflection of the electromechanical converter could be set. By adjusting a scanning ratio between 0% and 100%, the amplitude of the electromechanical converter could consequently be set arbitrarily between a minimum deflection and a maximum deflection.

It can be desirable to selectively set a certain amplitude of the electromechanical converter. This certain amplitude could correspond, for example, to an operating state in which the electromagnetic valve has a defined position. Such a position could connect, for example, inlets or outlets or so-called ports of the valve to each other. Thus, for example, a fluid flow or a direction of a fluid flow could be influenced by the valve.

The amplitude and particularly the length or the magnitude of a deflection that could be achieved by the excitation of an electromagnetic converter here could be dependent on an ambient temperature.

An operating state can be characterized, for example, by a hold scanning ratio. This hold scanning ratio can correspond to a given relative movement of a camshaft to a reference point. For example, the hold scanning ratio could correspond to a valve position or a setting of a valve in a certain position.

For determining the relative movement, the movement of the camshaft to a reference point could reference the crankshaft or vice versa. For this purpose, different methods could be used. One example for determining the relative movement could be explained with reference to determining the relative movement of the camshaft to the crankshaft in a motor. The crankshaft could have a Hall sensor that could by read by sensors. A toothed ring whose teeth generate an inductive pattern when passing the Hall sensor could be arranged on the crankshaft. This pattern could be evaluated by which it is possible to follow the rotation of the crankshaft.

By forming special marking on the toothed ring, for example, an enlarged tooth, a certain reference point of the crankshaft could be defined.

The movement of a similarly moving camshaft can be referenced to this reference point, by which the relative movement between the camshaft and the crankshaft can be determined. The position of the camshaft can be determined by four plate-wheel transducers. The plate-wheel transducers could be 4 vane-like plate-wheel transducers. The position of the vanes could also be polled by existing pulse sensors and in this way a relationship to the reference point could be established.

Using the valve position that could be set, for example, by a hold scanning ratio, a fluid flow through the valve could be influenced such that a relative position of a camshaft adjuster remains constant. In other words, this means that a camshaft adjuster could have a stator and a rotor. The rotor could be connected to a camshaft, while the stator is driven by a control chain. Using a vane in a hydraulic chamber, the hydraulic chamber could be divided into an A chamber or retarded chamber and a B chamber or advanced chamber.

By a fluid flowing through one of the two chambers, the vane could be forced into the other of the two chambers. Through the displacement of the vane or the separating element, a relative movement between the stator and the rotor of the camshaft adjuster could be produced. Consequently, a phase angle between the stator and the rotor could be set by a hydraulic system. For example, a phase angle or a phase shift between a camshaft and a crankshaft could be set. For this purpose, the rotor could be coupled with the camshaft and the stator could be coupled with the crankshaft. For coupling the stator with the crankshaft, a control or timing chain could be used.

A reference point could be, for example, a phase adjustment angle between the rotor and stator of 0°. For securing the reference point, the rotor and the stator could be locked by mechanical locking at the reference point, that is, when there is a phase angle of 0°. The mechanical locking could be desired, when a minimum pressure has not yet been established for activating the rotor.

In addition to knowledge of an allocation of a hold scanning ratio at a certain ambient temperature, it could be desirable to recognize another scanning ratio, wherein the other scanning ratio corresponds to another operating state in addition to the operating state of the hold scanning ratio. In the hold scanning ratio, the valve could be set so that a relative movement of the camshaft to the reference point is essentially stopped. For example, when a hold scanning ratio is set, a set phase shift between the rotor and stator is maintained.

Another example for another scanning ratio that could be of interest for the operation of a central valve might be a scanning ratio at which the valve is set so that the operating chamber B is filled with the fluid, for example, a pressure oil, while the chamber A is emptied.

Another example of a scanning ratio of interest could be a scanning ratio that corresponds to a valve position, wherein, at the scanning ratio, the chamber A is indeed emptied, but no fluid is fed to the chamber B. At the hold scanning ratio, there could be a valve position at which fluid is fed essentially neither to the chamber B nor to the chamber A and a fluid is also drawn from essentially neither of the two chambers. Merely the quantity of fluid that compensates for fluid losses due to existing leakage could be fed to the chamber A or the chamber B. In particular, the position at a reference point or the relative position of the camshaft to the crankshaft at a set hold scanning ratio does not change.

At another scanning ratio of interest, a fluid could be fed to the chamber A, while fluid could be drawn from the chamber B or while the fluid could be drained from the chamber B.

If fluid is fed to the chamber B, a phase difference between the camshaft and the crankshaft could be set such that valves of a combustion chamber that are activated by the cams of the camshaft at a retarded position relative to the position of the shaft at the reference point or at the position of the shaft in the center locking position. When fluid is fed to the chamber A, the vane could be forced in the direction of the chamber B, by which an advanced activation of the valves could be set relative to the reference point. The setting of an advanced or a retarded phase angle could create better exhaust-gas behavior of a motor. In other words, oil pressure in the chamber A means that it is adjusted out from the base, while pressure in the chamber B could lead to an adjustment into the base. Through the use of a pump that is connected by a corresponding valve position to the chamber B, pressure could be exerted on the chamber B.

According to another embodiment of the present invention, the one or more other scanning ratios of the scanning ratio characteristic curve for the valve could be determined by a motor control device. In this way, through the use of the motor control, the position of a valve could be set until a property that is typical for the desired operating state can be recognized. The characteristic curve thus could be traversed in that the conditions for certain states are set.

Similar to the hold scanning ratio, through this it can also be determined when a relative movement of a crankshaft to a reference point is essentially zero and thus has stopped, the other scanning ratios could be determined by the motor control. In this way, a relative movement that is relevant for an operating state between the camshaft and a reference point could be predetermined and the scanning ratio could be adjusted until it is recognized by sensors that the relative movement that can be predetermined for an operating state has been reached. The scanning ratio determined in this way could be stored, in order to reliably set the corresponding operating state at the ambient temperature. It is also conceivable to store the scanning ratio as a function of other parameters like the rotational speed or the motor temperature.

For the purpose of feedback on the relative movement or other instantaneous, prevailing conditions, the motor control could poll sensors that could be mounted, for example, on a shaft. A sensor with which the rotational speed or the rpm of a shaft could be determined, could be a Hall sensor. The Hall sensor could be mounted in the cylinder head of the motor, while only transducers could be positioned on the camshaft. This type of sensor data detection could allow a simple data transmission from the rotating camshaft to the stationary cylinder head.

Thus, for example, the scanning ratio that corresponds to the filling of the chamber B and the discharging of the chamber A could be determined in that a phase difference between the camshaft and the crankshaft is changed in the direction of a retarded phase angle with reference to the reference point. Conversely, the scanning ratio in which the chamber A is filled and the chamber B is emptied could be determined in that a phase difference is set in the direction of an advanced phase difference. The direction of the change could be determined by means of the motor control from the incoming signals of the sensors.

In addition to determining the rotational speed, an operating state could also be determined via a fluid throughput. The operating state in which a fluid flow to the chamber B has stopped, while chamber A is emptied, could be determined in that it is detected that there is not flow in a line to chamber B, while a phase angle is set in the direction of a retarded phase angle. This setting could be performed until a center position, that is, for example, a phase difference corresponding to the reference point of 0° between the stator and rotor has been set. In the center position, center locking can engage. The center locking could be realized, for example, by two bolts, wherein the bolts each engage in locking connecting elements provided for this purpose. The state of the mechanical locking could be recognized with sensors that recognize a locked locking bolt or two locked locking bolts. Consequently, it could be recognized whether the camshaft adjuster remains in a position.

The determined scanning ratios corresponding to appropriate operating states for a certain ambient temperature could be stored in the motor control in a characteristic curve or in a characteristic map and, in particular, as points or ranges of a characteristic curve map.

According to yet another embodiment of the present invention, the one or more other scanning ratios of the scanning ratio characteristic curve for the valve could be determined by the structural design of the valve based on the determined hold scanning ratio.

According to the geometric construction of the valve, for example, by forming port openings in the valve housing or by annular grooves and connection channels in a control piston of a valve in certain intervals, the desired operating states could correspond to a deflection of a control piston in a valve housing. The deflections of the control piston could correspond to scanning ratios of the electromechanical converter or an electromagnet. Through calculation, starting from the hold scanning ratio determined at a certain ambient temperature, the one or more other scanning ratios of the scanning ratio characteristic curve could be determined or calculated.

According to another exemplary embodiment of the present invention, the determined other scanning ratio of the scanning ratio characteristic curve is stored. By storing the characteristic curve or by storing selected points of the characteristic curve, a motor control could refer back at any time to a scanning ratio characteristic curve that is valid for a certain ambient temperature. Here, the scanning ratio characteristic curve could also be stored for the hold scanning ratio in a motor control device. The storage could be realized here in a RAM (Random Access Memory), an EPROM (Erasable Programmable Read Only Memory), an EEPROM (Electrically Erasable PROM), or a Flash EPROM.

Therefore, the characteristic curve could also remain after an ignition has been turned off and when the motor is restarted, a desired operating state could be set according to a scanning ratio of the characteristic curve.

According to yet another exemplary embodiment of the present invention, the method is constructed for operating a five/four or 5/4 port directional control valve.

A five/four port directional control valve has five valve positions in which four connections or connecting ports could be connected to each other in a certain way. The five positions of the valve could correspond to five operating states or five scanning ratios. However, the scanning ratio that is allocated to an operating state could change as a function of several parameters, such as, for example, temperature. Here, the scanning ratios could also correspond to scanning ratio ranges, because often a small deviation from a scanning ratio could have a desired effect for a certain operating state. A deviation could exist, because compensation could be required, for example, due to leakage or tolerances that could be traced back to expansions due to temperature differences, partially non-sealed gap seals, production tolerances, etc.

According to yet another exemplary embodiment of the present invention, the method for operating a central valve is constructed with center locking. Center locking can involve, for example, two bolts that could ensure, mechanically, in a non-energized state for a fixed phase ratio between the rotor and the stator of a camshaft adjuster and, in particular, between the camshaft and the crankshaft. It could be necessary to trace back to mechanical locking, if, for example, a hydraulic pressure is not yet sufficient for hydraulic phase regulation. In order to prevent uncontrollable movement between the rotor and the stator, a defined phase difference could be set by the center locking.

According to another exemplary embodiment of the present invention, the ambient temperature could be determined by measuring a motor temperature. The motor temperature could here be determined in the form of a water temperature and, in particular, the cooling water temperature or a temperature of the oil of the motor oil circuit. The ambient temperature is determined by a motor temperature, that is, indirectly, but temperature sensors that are possibly already present in a motor could be used. In this way it is prevented that additional sensors must be provided for determining the temperature in the valve and, in particular, in the camshaft adjuster.

According to another exemplary embodiment of the present invention, the electromechanical valve has an electromagnet. Determining the ambient temperature for fixing a temperature for the validity of the scanning ratio characteristic curve could be performed here by measuring a temperature of the electromagnet.

The resistance of a coil that could be present in an electromagnet can depend on the ambient temperature. When adjusting a voltage for supplying the electromagnet, a corresponding current that can generate the deflection of the electromagnet and thus the valve position could be set based on the electrical resistance of a coil of the electromagnet. At a high temperature, the resistance of the coil could also be high, by which a current that is lower in comparison with a lower temperature can flow through the electromagnet. Therefore, despite the setting of an equal scanning ratio for a high and a low temperature, a different amplitude of the electromagnet could be realized.

To be able to reach the same position of the valve for a set scanning ratio and, in particular, to reach the same amplitude at different temperatures by setting a different scanning ratio, it could be desired to determine the temperature of the electromagnet, in order to be able to estimate the effects of the temperature on the amplitude of the electromagnet.

Ostensibly, this means that a method for regulating could be provided for a hydraulic camshaft adjuster with center locking and emergency running in the base position. Emergency running in the base position can mean that an emergency running position of the valve could be reached when the valve is switched to a non-energized position. For example, in an emergency situation it can occur that a power supply of the valve and especially of an electromechanical converter of the valve fails. Therefore, the valve is brought into an emergency running position. In the emergency running position, it can be desired to control or to regulate the phase angle between the rotor and stator, in order to avoid undesired noises. It can also be desired, in an emergency running situation, to force a phase angle in the direction of an advanced phase angle, in order to achieve, for a later motor start, locking of the camshaft adjuster in a center locking position.

Through the application of the method according to the invention, it can be avoided that a hydraulic camshaft adjuster with center locking requires additional modules. By avoiding additional modules, an installation space for the valve could have an equal or identical construction in comparison with a hydraulic camshaft adjuster with end position locking. Through the application of the method, a proportional valve could be used for the hydraulic camshaft adjuster with center locking, wherein the proportional valve for the hydraulic camshaft adjuster with center locking can require no additional installation space in comparison with the proportional valve for the hydraulic camshaft adjuster with end position locking.

Through the application of the method, a hydraulic camshaft adjuster with center locking can achieve the function in connection with an adapted proportional valve, i.e., a proportional valve with adapted operating states, without requiring complicated components or concepts. An influence on the components can be ruled out.

For example, a hold scanning ratio, a first scanning ratio, a second scanning ratio, and a third scanning ratio could be determined in that a hold scanning ratio is determined by a motor control device and stored in the characteristic map or characteristic curve map. Determining the first scanning ratio of the second scanning ratio and the third scanning ratio can be performed, for example, in two ways. The motor control device can determine the scanning ratio points and it can store the scanning ratio points in another characteristic map or characteristic curve map. However, the first scanning ratio and the second scanning ratio can also be determined by the structural design and the resulting valve characteristics in direct relationship to the hold scanning ratio.

A scanning ratio can be a percentage in the range from 0% to 100%. The first scanning ratio can be determined in that a first percentage is taken from the hold scanning ratio, the second scanning ratio can be determined in that a second percentage is taken from the hold scanning ratio, and the third scanning ratio can be determined in that a third percentage is taken from the hold scanning ratio. The first percentage, the second percentage, and the third percentage could be constant and could depend on the geometry of the valve, in particular, on the characteristics of the valve.

Many improvements of the invention were described with reference to the method for determining a scanning ratio for a characteristic curve for operating an electromechanical valve of a camshaft adjuster. These constructions are also valid for the computer program product and the data carrier with the computer program product.

BRIEF DESCRIPTION OF THE DRAWINGS

Below, advantageous embodiments of the present invention will be described with reference to the figures.

DETAILED DESCRIPTION OF THE PREFERRED EMBODIMENTS

The diagrams in the figures are schematic and not to scale. In the following description of FIGS. 1 to 5, the same reference symbols are used for the same or corresponding elements.

Figure 1:
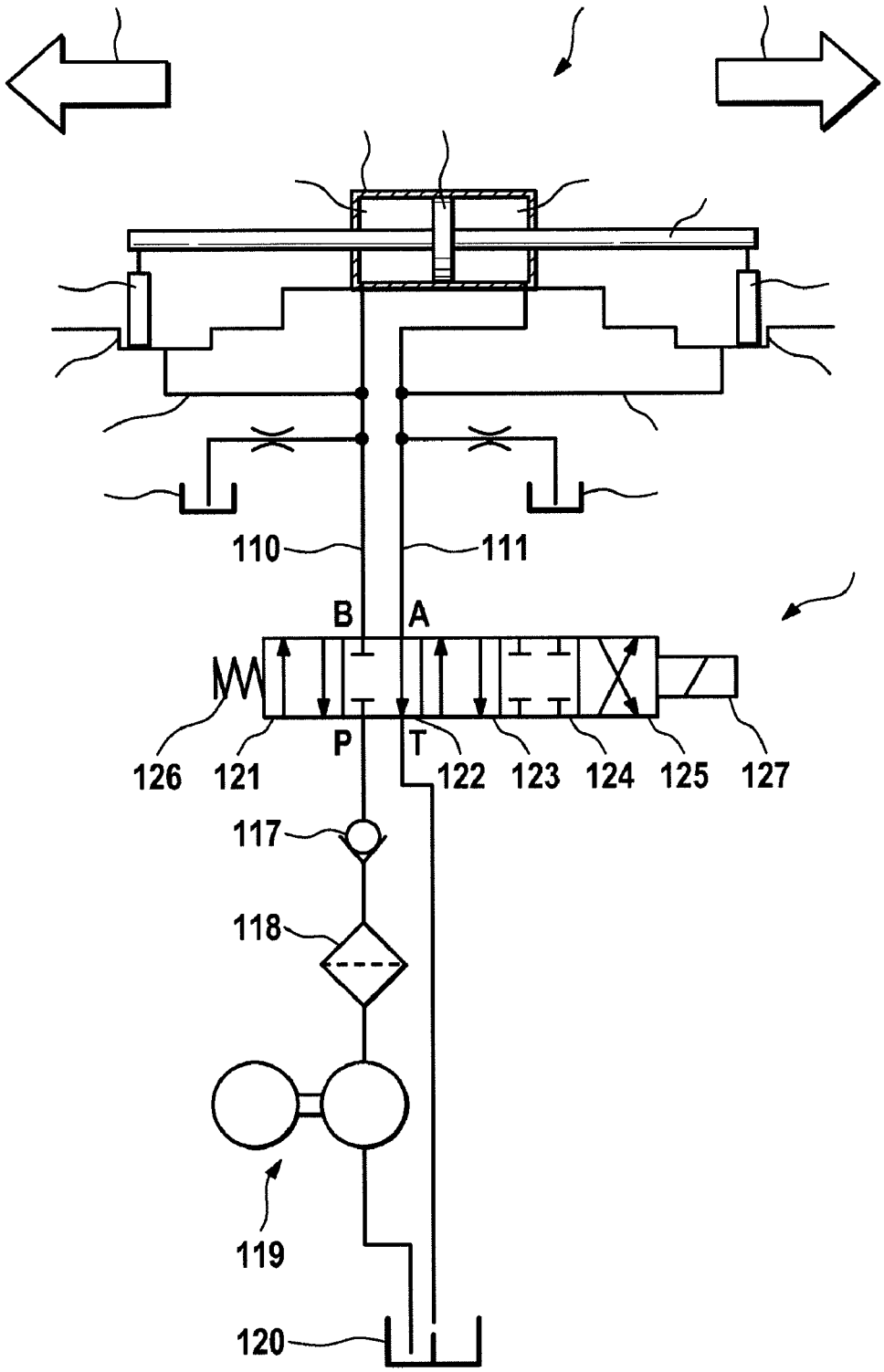
FIG. 1 shows a schematic block circuit diagram of a camshaft adjuster with center locking according to an exemplary embodiment of the present invention.

FIG. 1 shows a schematic block circuit diagram of a camshaft adjuster with center locking according to an example embodiment of the present invention. The camshaft adjuster 100 has the hydraulic chamber 101 with the vane 102. As a separating wall, the vane 102 divides the hydraulic chamber 101 into the chamber A' and the chamber B'. The vane 102 has an axle 103 arranged symmetrically on its sides, wherein the axle 103 is connected to the locking bolts 108, 109. If the chamber B' is filled with a fluid, for example, a pressure oil, and if a pressure is exerted, in particular, on chamber B', then the vane 102 moves in the direction of chamber A'. This movement can correspond to a movement of a rotor connected to the vane 102 of a camshaft adjuster into a retarded adjustment position. The retarded adjustment direction is indicated by the arrow 104 in FIG. 1.

A retarded phase angle corresponds to a retarded adjustment position and means that the cams of the camshaft connected to the rotor activate the valves of the motor at a more retarded position than for the center position of the vane 102 shown in FIG. 1.

When the chamber A' is filled with pressure oil, the vane 102 moves in the direction of the chamber B', by which the volume of the chamber B' is reduced and the volume of the chamber A' is increased and a phase angle between the rotor and the stator of a camshaft adjuster is forced into an advanced position. The advanced position is indicated in FIG. 1 by the arrow 105. The rotor and the stator of the camshaft adjuster 100 are not shown in FIG. 1.

FIG. 1 shows the camshaft adjuster 100 in a mechanically locked state. Here, a phase angle between the rotor and stator is fixed. This phase angle or the phase difference equals 0° in the state of the camshaft adjuster 100 shown in FIG. 1.

The hydraulic chamber 101 is connected to a stator of the camshaft adjuster and the center position of the vane 102 consequently corresponds to a phase difference of 0° between the rotor and stator of the camshaft adjuster.

For the mechanical locking of the center locking position, that is, for a phase angle of 0° between the rotor and stator, the camshaft adjuster has the staircase-shaped locking connecting element 106 and the staircase-shaped locking connecting element 107. The locking connecting elements 106 and 107 are connected to the housing of the hydraulic chamber 101.

The two locking bolts 108 and 109 are connected to the axle 103 and thus follow an axial movement of the axle 103 of the model of the camshaft adjuster 100. The locking bolts 108 and 109 are constructed such that they mechanically lock in the locking connecting elements 106, 107 for a small pressure of a fluid, for example, a smaller pressure than the system pressure, oil pressure, or fluid pressure. The locking bolts 108, 109 should lock when the fluid pressure in the chambers A' and B' no longer hydraulically clamp the vane 102.

In a locked operating state, the locking bolt 108 prevents, in the connecting element 107, a movement of the fluid 102 in the direction of the chamber A', that is, in the direction of a retarded phase angle. The locking bolt 109 prevents, in a locked state, a movement of the vane 102 in the direction of the chamber B', that is, in the direction of an advanced phase angle.

For pressurizing the chamber B', the pressure line 110 is coupled with the chamber B'. For pressurizing the chamber A', the pressure line 111 is connected to the chamber A'. Through the use of the pressure lines 110 and 111, a fluid can be fed both to the chambers A' and B', and can also be drained from the chambers A' and B'. The pressure line 112 that creates a connection between the pressure line 110 and locking connecting element 107 is coupled to the pressure line 110. As soon as, in the pressure line 110, a fluid charged with a pressure flows into the chamber B', the locking bolt 109 is unlocked by means of the fluid that is fed via the pressure line 112 to the locking connecting element 107.

The pressure line 111 is likewise connected by the pressure line 113 to the locking connecting element 106. Consequently, as soon as a pressure is present on the line 111, the locking bolt 108 is unlocked by the pressure output 113.

Leakage that occurs, for example, when the pressure lines 110, 111 are connected to the pressure chamber A', B' and the locking connecting elements 107, 106, is indicated by the leakage 114 and 115. Therefore, in the block circuit diagram of FIG. 1, a loss of fluid is taken into account based on connection gaps. The consideration of the presence of leakage allows a system that is functional for a long time to be able to realized despite the resulting wear. Leakage can occur in the adjuster, on the valve, in the rotational transmitter, or at other positions. The overall system, however, is designed such that it takes into account this leakage and can be controlled reliably despite the leakage.

The pressure line 110 is connected to the working port B of a five/four port directional control valve 116 or 5/4 valve 116. The pressure line 111 is connected to the working port A of the 5/4 valve 116. The pressure oil port P of the proportional valve 116 or the central valve 116 is connected to the non-return valve 117 and the non-return valve 117 is connected to the oil filter 118. Using the oil pump 119 connected to the oil filter, the pressure oil port P is supplied with a fluid or pressure oil from the tank 120. The tank 120 is connected to the tank port of the central valve 116 and is used as a collection basin for fluid that runs out of the valve.

The central valve 116 has the five valve positions 121, 122, 123, 124, and 125 that could be set by a linear displacement of the valve 116. For setting a valve position, the central valve 116 moves in a linear motion between the non-return element or the spring 126 and the electromagnet 127. By energizing the electromagnet 127, a deflection of the electromagnet is generated in the direction of the spring 126.

Through setting a scanning ratio on the electromagnet 127, the length or magnitude of the amplitude in the direction of the spring 126 can be influenced. FIG. 1 shows the proportional valve 116 in the second operating state 122. In the second operating state 122, the working port B is separated from the pressure-oil port P. This is indicated in FIG. 1 by the T-shaped symbol in the symbol for the valve position of the second operating state 122.

The working port A and the tank port T are connected to each other in the second operating state. Through this coupling, a discharge of oil located in chamber A' to the tank 120 is possible via the tank port T. This is indicated by the arrow in the second operating state 122. In order to achieve the second operating state shown in FIG. 1, the electromagnet 127 is energized with a scanning ratio lying between 0% and 100%.

The operating state 121 is adjustable when the electromagnet is not energized or when the electromagnet has a scanning ratio close to 0%. The return spring 126 forces the proportional valve into a non-energized state in the direction of the electromagnet 127 and thus automatically sets the first operating state 121. In emergency running, because the electromagnet is typically switched or will be switched without power, the emergency running state 121 corresponds to the state 121. In the emergency running state 121, the pressure oil port P is connected to the working port B and the working port A and the tank port T are connected. Thus, in emergency running, the camshaft adjuster 100 could also be supplied with oil.

In the position in which the valve 116 is switched without power (e.g., emergency running), there is a small valve overlap of the combustion valves, by which unrestricted operation of the motor could be achieved.

Even in the non-energized state 121, it should be possible to determine a defect with the ODB (On-Board Diagnostics System). Thus, even in the emergency running position 121, a recognition of a defect should also be possible. Therefore, the valve is switched completely without power only in emergency running. If the position 121 is assumed under non-emergency running conditions, then a small scanning ratio (e.g., 5%) is set. In this way, it can be detected when a defect, such as, e.g., a disconnected plug, a burned-through coil, etc., has occurred.

The second state 122 can be set when the scanning ratio of the holding state 124, the so-called hold scanning ratio or hold TV has been determined.

If a scanning ratio is set that corresponds to the third operating state 123, pressure oil is fed into the chamber B' and drained from the chamber A'. Thus, the locking bolt 109 is unlocked and an adjustment in the direction of a retarded phase angle is possible.

If the adjustment of the phase angle has reached a desired position, then through setting the hold scanning ratio and thus the fourth operating state 124, the pressure in the chambers B' and A' could be held constant. In other words, this means that a connection between the working port B and the pressure oil port P and a connection between the working port A and the tank port T in the fourth operating state 124 is interrupted and thus oil is neither fed to nor discharged from the chambers B' and A'. A previously set advanced or retarded phase angle is maintained by setting the hold operating state 124.

By setting the fifth operating state 125, the pressure oil port P is connected to the chamber A' and the chamber B' is connected via the working port B to the tank port T. Consequently, oil is fed to the chamber A' and drained from the chamber B' and the vane 102 moves in the direction of an advanced adjustment position due to the unlocking of the locking bolt 108.

Through the use of the operating states 123, 124, and 125, hydraulic clamping could be achieved during the operation of the camshaft adjuster 100. With the operating state 122, mechanical clamping of the vane 102 or the adjuster could be realized. In emergency running 121, by supplying hydraulic pressure to the chamber B', it can be prevented that uncontrolled movement of the vane 102 takes place.

Figure 2:
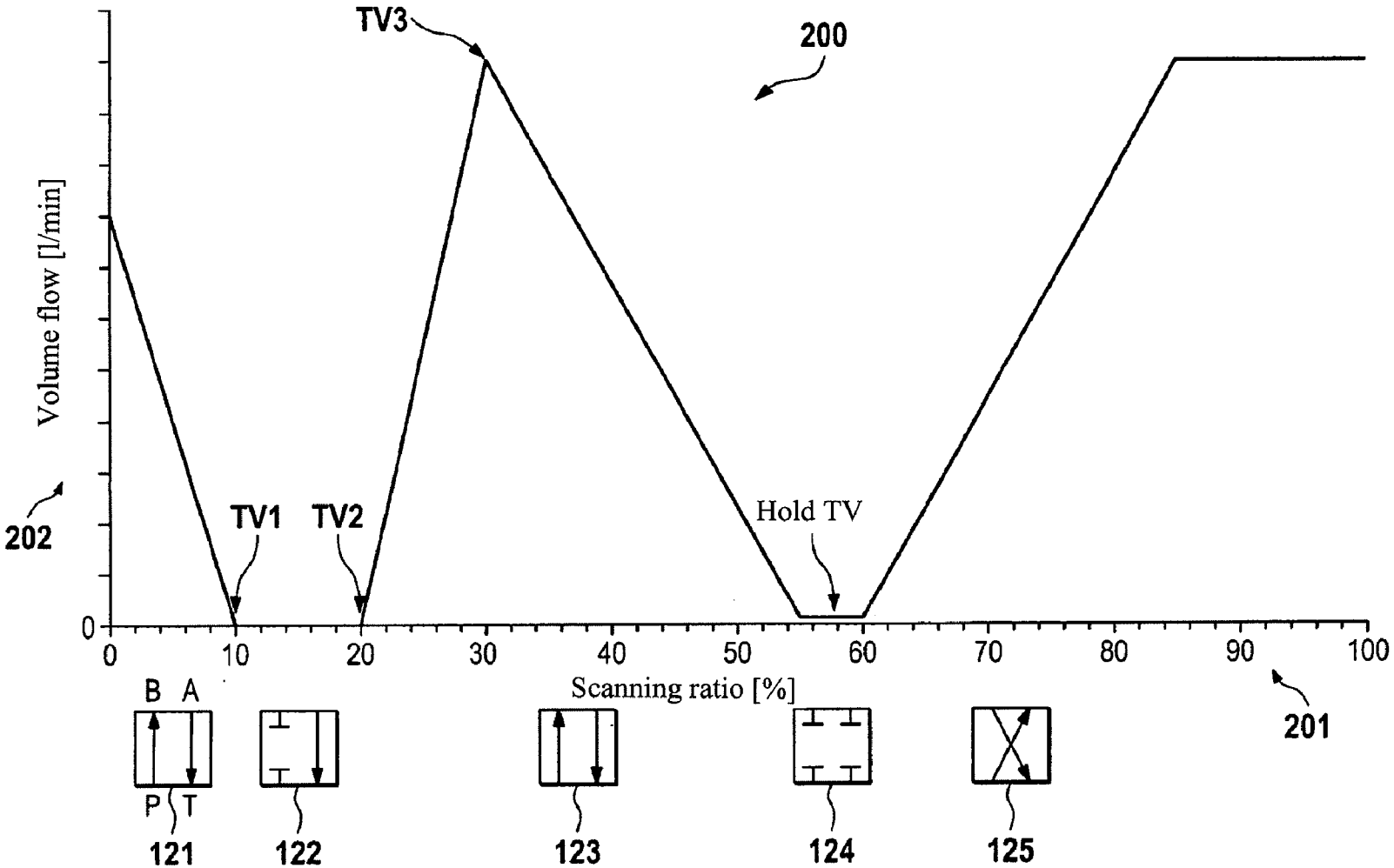
FIG. 2 shows a volume flow characteristic curve with determined scanning ratio according to an exemplary embodiment of the present invention.

FIG. 2 shows a volume flow characteristic curve with determined scanning ratios according to an exemplary embodiment of the present invention. In FIG. 2, the volume characteristic curve 200 is shown. The volume characteristic curve characterizes a corresponding volume flow for the setting of the scanning ratio from 0% to 100%. For this purpose, in the diagram the scanning ratio TV is specified in percent on the axis 201 or abscissa 201 and the volume flow is specified in liters per minute or l/min on the axis 202 or the ordinate 202. Under the axis 201, an operating state of the valve 116 corresponding to the scanning ratios is shown. The operating states 121, 122, 123, 124, and 125 correspond to the operating states shown in FIG. 1.

The position of the characteristic curve 200 and the position of the operating states 121, 122, 123, 124, 125 or the allocation of the operating states 121, 122, 123, 124, 125 is here valid for a certain ambient temperature of the camshaft adjuster of, for example, 90° C. For a different temperature, a different position of the scanning ratio 201 could be produced. The characteristic curve shown in FIG. 2 has five scanning ratio ranges. The first operating state 121 that is also assumed in emergency running reaches from 0 to 10%. The limit of the range is characterized in FIG. 2 with TV1. TV1 can here be determined as a function of a known hold TV by subtracting a previously determined percentage at a certain temperature. As long as a scanning ratio is set in the range from 0 to TV1 on the electromagnet 127, the valve position 121 is active. The volume of a fluid flow could change, however, due to the position of the valve as a function of the scanning ratio.

In the characteristic curve 200 it is to be seen that, by enlarging the scanning ratio from 0% up to TV1, the volume flow from the pressure oil port P into the chamber B' decreases. The decrease depends on the set proportional valve. When the scanning ratio TV1 is reached, the second operating state 122 is active, by which a flow of pressure oil into the chamber B' is stopped.

The scanning ratio TV2 lies at 20% in FIG. 2. When an amplitude of the valve 116 is reached that corresponds to the scanning ratio TV2, the third operating state 123 becomes active. Due to the valve characteristics, for example, an increase or decrease of an inflow opening until the hold TV is reached, the volume inflow to chamber B' has a maximum at the scanning ratio TV3. At a scanning ratio between the hold TV and TV3, the operating state 123 is still active, but the volume inflow to chamber B' decreases with an increasing amplitude of the electromagnet 127.

When the hold TV is reached that comprises, in FIG. 2, a range from 55% to 60%, the hold state 124 is active. Neither the chamber B' nor the chamber A' is supplied with pressure oil during the application of the hold TV. In the state 124, no pressure oil is also drained from the chambers A' and B'. A set state is maintained at a scanning ratio of 55% to 60%.

In the range of a scanning ratio of 60% to 100%, the fifth operating state 125 is active. The rising volume flow in the range from 60% to 84% leads to an increasing volume inflow into the chamber A'. At very low temperatures, the range of the increasing volume flow can begin, instead of at 60%, at, e.g., 50%.

Starting at a scanning ratio of 84% to 100%, the volume inflow to the chamber A' remains constant. The curve therefore has at a scanning ratio of 84%, an inflection point, and continues in a straight line parallel to the abscissa 201. The characteristic curve 200 is a schematic diagram that illustrates the principles. The inflection points shown in FIG. 2 could also be rounded accordingly.

In a scanning ratio range from TV2 to 100%, hydraulic clamping of the vane 102 is performed. By setting a scanning ratio of TV2 up to the hold TV, a phase angle between the rotor and stator could be set in the direction of a retarded position. By setting a hold TV, the rotor 102 could be held in the currently set position, that is, at a currently set advanced or retarded phase angle. By setting a scanning ratio from the hold TV to 100%, the vane 102 could be brought into the direction of an advanced setting position. Setting the vane in an advanced setting position allows, when the motor is turned off, a freely moving rotor to be able to captured by the center locking due to drag moments for a subsequent starting process. Therefore, it is desired to bring the vane 102 into an advanced position when being shut down.

Figure 3:
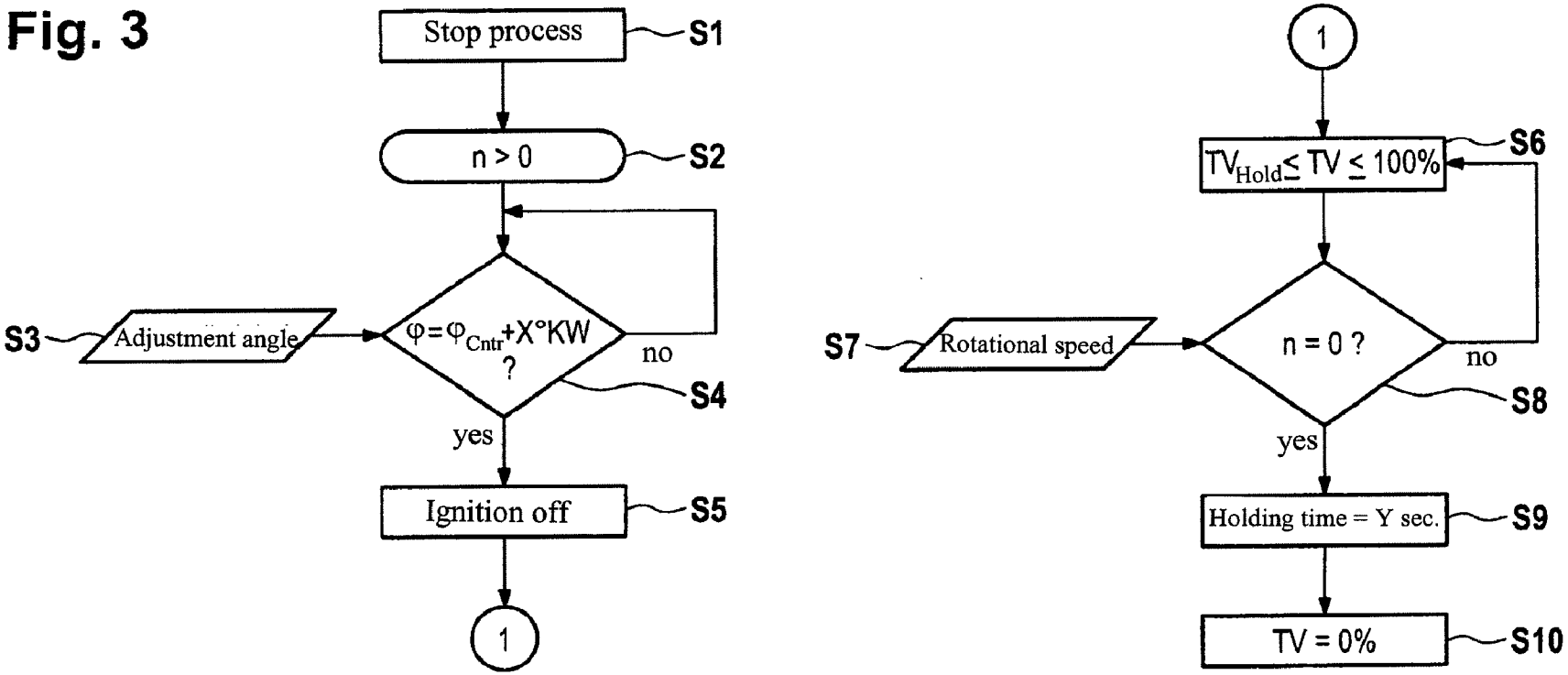
FIG. 3 shows a method for stopping a motor according to an exemplary embodiment of the present invention.

FIG. 3 shows a method for stopping a motor according to an example embodiment of the present invention. The method for stopping the motor begins with the recognition of a stop condition in S1, e.g., turning off the ignition. Following this, in S2, is the recognition of an engine speed. If the motor is rotating, i.e., if the rotational speed is greater than zero, then an adjustment angle is given. This adjustment angle corresponds to an adjustment angle in a position that lies at an advanced position relative to the center position or the center locking position.

In step S4, a test is performed whether the adjustment angle or the phase difference $\phi$ is in an advanced position. For this purpose it is tested whether $\phi$ has a greater angle than a reference angle $\phi_{Center}$. The test is performed with reference to the formula $\phi=\phi_{Center}+X°KW$. Here, X°KW is greater than 0 and designates twisting relative to the crankshaft. The test takes place until the condition from S4 is achieved. $\phi_{Center}$ corresponds to the phase angle of a reference position.

Only when the advanced adjustment angle has been set is the motor shut down in S5. The supply for the electromagnet 127, in particular, the current or voltage supply, however, is maintained. In S6, a scanning ratio is set between $TV_{Hold}$ and 100% or between the hold TV and 100%. Thus, the fifth operating state 125 shown in FIG. 2 is active. The condition equation corresponds to $TV_{Hold} \leqq TV \leqq 100\%$. Consequently, the chamber A' could be charged with pressure and the rotor 102 could be held in the advanced position.

The electromagnet 127 is energized until the rotational speed of the motor determined in step S7 or the rotational speed of a shaft associated with the engine speed has been recognized in S8 as 0. Then the motor is stationary. After the engine stops, by energizing the electromagnet 127, in S9 a holding time could still be maintained, by means of which the reliability of landing in an advanced position could be increased. Only then, in step S10, is a scanning ratio of 0% set by turning off the energizing of the electromagnet 127. In this way it is guaranteed that a battery is not unnecessarily loaded after the shutdown process that could represent the current supply of the electromagnet 127.

Figure 4:
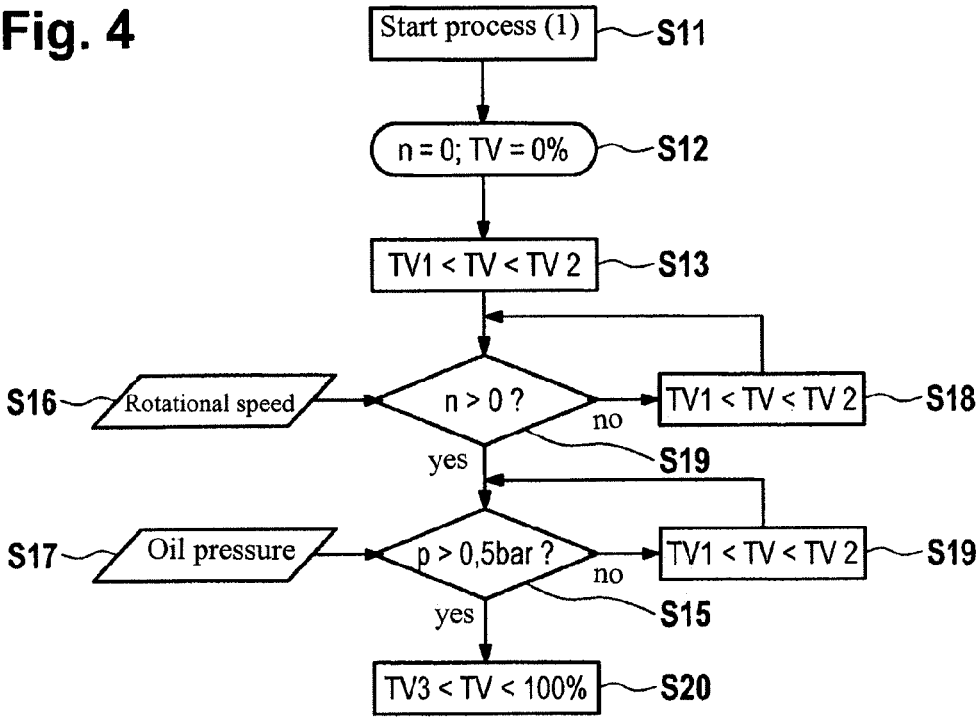
FIG. 4 shows a method for starting a motor according to an exemplary embodiment of the present invention.

FIG. 4 shows a method for starting a motor according to an example embodiment of the present invention. In step S11, a start condition, for example, the startup of a motor, is recognized. Here, in step S12, the engine speed equals 0 and the set scanning ratio is also 0%. Because the characteristic curve is stored with corresponding scanning ratios in a motor controller, the characteristic curve could be retrieved by the motor controller and, in particular, the characteristic curve values TV1 and TV2 could be retrieved.

In step S13, with the retrieved values TV1 and TV2 on the electromagnet 127, a scanning ratio is set that corresponds to the second operating state 122, wherein the chamber B' is not supplied with pressure oil and the chamber A' could be emptied via the working port A and the tank port T in the direction of the tank 120. Through the drag moments, a rotor that is stationary in an advanced position could thus be rotated in the direction of a retarded position until the center locking engages and, in particular, until the bolt 108 makes a contact in its connecting element. As soon as the center locking is reached, the rotor and the stator are coupled mechanically by means of the bolts 109 and 108 and thus a relative movement between the rotor and stator could be prevented. The scanning ratio between TV1 and TV2, that is, the operating state 122, is maintained until a rotational speed deviating from 0 is reached in S14 and a system pressure has been established in step S15. The rotational speed is determined in S16, for example, by polling a Hall sensor that is arranged on the camshaft or on the crankshaft and the oil pressure is polled in S17 by polling an oil pressure sensor that is arranged, for example, on the oil pump 119.

The steps S18 and S19 guarantee that the operating state 122 is maintained. Only when the system pressure of, for example, 0.5 bar has been reached, could hydraulic regulation of the camshaft adjuster be achieved. If this minimum oil pressure is set, in step S20 the state determined from the characteristic curve map is set between TV3 and 100% as a function of the phase adjustment angle to be set between the rotor and the stator. In this way, the rotor is held hydraulically.

The camshaft adjuster 100 is regulated by setting another scanning ratio TV1, TV2, TV3. A scanning ratio greater than the hold scanning ratio is also conceivable.

Figure 5:
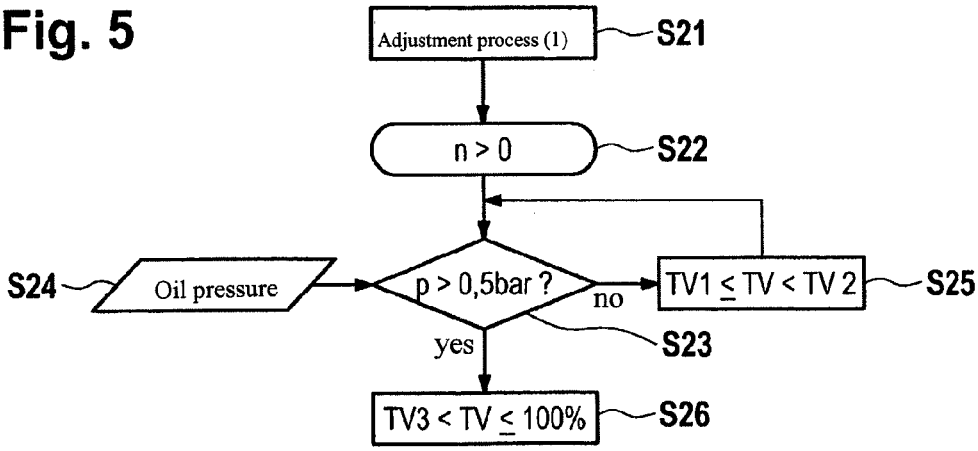
FIG. 5 shows a method for adjusting and/or regulating a camshaft adjuster according to an exemplary embodiment of the present invention.

FIG. 5 shows a method for regulating and/or adjusting a camshaft adjuster according to an example embodiment of the present invention. The beginning S21 of the adjustment process corresponds, for example, to the reaching of the state S20 after the motor is started. In S22, the testing of the engine speed takes place. At an engine speed deviating from 0, n>0, the regulation of the camshaft adjuster can be performed. In a loop S23, the system oil pressure in step S24 is polled by an oil pressure sensor. If the determined oil pressure does not correspond to a minimum system pressure of, for example, 0.5 bar, then, in step S25, mechanical locking of the camshaft adjuster is achieved, in that a scanning ratio between TV1 and TV2 is set. For setting the scanning ratio of TV1 and TV2, the determined characteristic curve and the characteristic curve stored in the motor controller can be referenced.

When the scanning ratio range from TV1 to TV2 is determined, a temperature dependency of the scanning ratio TV1 and TV2 has already been taken into account. Setting a scanning ratio between TV1 and TV2 allows a rotor located in an advanced position to be captured due to drag moments in the center position or center locking. In step S25, mechanical coupling of the camshaft adjuster 100 is realized. Only when a desired oil pressure is reached again in S23 could the system return to the hydraulic holding in step S26. For this purpose, a scanning ratio between T3 and 100% is set, that is, TV3≦TV≦100%.

Additionally, it is to be noted that "comprising" does not exclude other elements or steps and "a" or "one" does not exclude a plurality. Furthermore, it should be noted that features or steps that have been described with reference to one of the above embodiments could also be used in combination with other features or steps or other embodiments described above. Reference symbols in the claims are not to be viewed as restrictive.

The invention claimed is:

1. Method for determining a scanning ratio for a characteristic curve for operating an electromagnetic valve of a camshaft adjuster, comprising the steps: determining an ambient temperature of the camshaft adjuster, determining a relative movement of a camshaft to a reference point, setting a scanning ratio of the electromagnetic valve, so that a relative movement of the camshaft to the reference point is stopped, storing the set scanning ratio as a hold scanning ratio in a first operating state for the determined ambient temperature, determining another scanning ratio for another operating state for a scanning ratio characteristic curve of the valve at the determined ambient temperature based on the determined hold scanning ratio, further comprising a motor stoppage:

recognizing a stop condition, determining a rotational speed of a crankshaft, wherein the rotational speed of the crankshaft is coupled with a rotational speed of the camshaft, setting an adjustment angle of the camshaft adjuster deviating from a locking angle by setting another scanning ratio and by setting the hold scanning ratio holding the adjustment angle deviating from the locking angle as long as the rotational speed of the crankshaft deviates from 0.

2. Method for determining a scanning ratio for a characteristic curve for operating an electromagnetic valve of a camshaft adjuster, comprising the steps: determining an ambient temperature of the camshaft adjuster, determining a relative movement of a camshaft to a reference point, setting a scanning ratio of the electromagnetic valve, so that a relative movement of the camshaft to the reference point is stopped, storing the set scanning ratio as a hold scanning ratio in a first operating state for the determined ambient temperature, determining another scanning ratio for another operating state for a scanning ratio characteristic curve of the valve at the determined ambient temperature based on the determined hold scanning ratio, further comprising for a motor startup:

recognizing a start condition, holding the camshaft adjuster by a mechanism while a rotational speed of the crankshaft is equal to 0, wherein the rotational speed of the crankshaft is coupled with a rotational speed of the camshaft, increasing the rotational speed of the crankshaft, regulating the camshaft adjuster by setting another scanning ratio and by setting the hold scanning ratio when the rotational speed of the crankshaft deviates from 0 and a system pressure has been reached.

* * * * *